US005482059A

United States Patent [19]

Miraglia

[11] Patent Number: 5,482,059

[45] Date of Patent: Jan. 9, 1996

+

[54] TRIPLE ZONE MASCARA BRUSH

[75] Inventor: Loretta A. Miraglia, Monsey, N.Y.

[73] Assignee: Estee Lauder Inc., New York, N.Y.

[21] Appl. No.: 415,289

[22] Filed: Apr. 3, 1995

[51] Int. Cl.[6] ..... A45D 40/26; A46B 11/00

[52] U.S. Cl. ..... 132/218; 15/206; 15/160; 15/207.2; 15/DIG. 5; 15/DIG. 6; 401/129

[58] Field of Search ..... 132/216, 218, 132/320, 313, 317; 15/206, 160, 207.2, DIG. 5, DIG. 6; 401/129

[56] References Cited

U.S. PATENT DOCUMENTS

| | | | |
|---|---|---|---|
| 3,896,823 | 7/1975 | Spatz . | |
| 4,433,928 | 2/1984 | Kingsford . | |
| 4,446,880 | 5/1984 | Gueret et al. . | |
| 4,632,136 | 12/1986 | Kingsford . | |
| 4,733,425 | 3/1988 | Hartel et al. . | |
| 4,861,179 | 8/1989 | Schrepf et al. . | |
| 4,887,622 | 12/1989 | Gueret . | |
| 4,898,193 | 2/1990 | Gueret | 132/218 |
| 4,927,281 | 5/1990 | Gueret . | |
| 4,961,665 | 10/1990 | Fitjer . | |
| 4,964,429 | 10/1990 | Cole . | |
| 4,974,612 | 12/1990 | Gueret . | |
| 4,982,838 | 1/1991 | Ansbach | 132/317 |
| 4,993,440 | 2/1991 | Gueret . | |
| 5,161,554 | 11/1992 | Fitjer . | |
| 5,161,555 | 11/1992 | Cansler et al. . | |
| 5,197,497 | 3/1993 | Gueret . | |
| 5,238,011 | 8/1993 | Gueret . | |
| 5,335,465 | 8/1994 | Gueret . | |
| 5,339,841 | 8/1994 | Gueret | 132/218 |
| 5,345,644 | 9/1994 | Gueret | 132/317 |
| 5,357,987 | 10/1994 | Schrepf . | |

*Primary Examiner*—John G. Weiss
*Assistant Examiner*—Pedro Philogene
*Attorney, Agent, or Firm*—Pennie & Edmonds

[57] ABSTRACT

A mascara brush having three sections and three types of bristles is disclosed. The brush portion has a larger diameter middle section comprised of a combination of soft and stiff bristles in random configuration, and two end sections comprised of hollow filaments which preferably become progressively shorter towards the ends of the brush portion. The end sections exhibit less bristle density than the middle section. This improved brush configuration allows for optimal one-stroke mascara application.

21 Claims, 1 Drawing Sheet

TRIPLE ZONE MASCARA BRUSH

BACKGROUND OF THE INVENTION

The present invention relates generally to the field of mascara brushes, and in particular to mascara brushes having more than one type of bristle.

The typical mascara brush of the prior art comprises a multiplicity of bristles mounted to a helically twisted wire, such that the free ends of the bristles are disposed in a spiral configuration. The shape of the brush is generally cylindrical, having bristles of uniform length throughout the length of the brush, or conical, having progressively shorter bristles toward the brush tip. Bristle density varies, sometimes according to bristle diameter, but is generally known to be in the range of 10 to 60 bristles per turn. The twisted wire axis is usually supplied with a handle at the end opposite the bristles. This handle also typically serves as the cap for the mascara container which houses the brush when it is not in use and carries the mascara supply.

The conventional mascara brush employs relatively soft bristles of nylon composition. These bristles are typically cylindrical in shape and have a circular cross-section, although other shapes are taught in the art. The suppleness of the bristle material is essential for the purpose of picking up the mascara from the container and transporting it to the eyelashes. However, this type of bristle often results in clumping during application, because, while the bristles are soft enough to properly transport the mascara, they are too soft to provide the combing effect necessary to achieve uniform distribution of mascara to the eyelashes. As a result, a separate instrument has been required to comb the lashes during application with the conventional brush.

It has been suggested by the prior art to use two different types of bristles in the same brush, i.e., soft bristles for applying the mascara and stiff bristles for combing the applied mascara through the lashes. For example, U.S. Pat. No. 4,964,429 to Cole discloses a mascara applicator with alternating rows of flexible bristles and stiff teeth. U.S. Pat. No. 4,861,179 to Schrepf discloses a spiral mascara brush having soft and stiff bristles randomly intermingled throughout the length of the brush in specific proportion. However, the spiral configuration of these brushes does not allow for a uniform distribution of the bristle tips, which has been found to be better for the purpose of picking up and transferring mascara, especially mascaras of high viscosity.

U.S. Pat. Nos. 4,733,425 and 5,161,554 disclose the use of certain bristle types which, when used with the conventional twisted wire axis, result in a non-spiral bristle configuration. U.S. Pat. No. 4,733,425, for example, discloses the use of hollow bristle fibers which compress when gripped between the wire axis and flare outwardly in a random arrangement. Similarly, U.S. Pat. No. 5,161,554 discloses the use of bristles with varying diameter along the longitudinal axis of the bristle such that they produce a random configuration depending on where they are engaged with the wire axis. However, these patents do not solve the previously addressed problem of clumping without the use of a separate combing implement.

Another proposed solution is disclosed in U.S. Pat. No. 4,887,622 wherein a lesser bristle density is used in combination with a larger diameter and thus stiffer bristle in an attempt to provide a brush which will both evenly apply the mascara and separate the lashes.

Thus, there is a need for an improved mascara brush which allows for optimal transfer of a high viscosity mascara product to the lashes in a single stroke application, by providing maximum exposure of brush to the eyelashes and incorporating a combing implement to eliminate clumping.

SUMMARY OF THE INVENTION

It is an object of the present invention to provide a mascara brush which is capable of both applying mascara and combing the eyelashes so as to provide a uniform distribution of mascara to the eyelashes.

It is another object of the invention to provide a mascara brush which maximizes the exposure of the lash to the mascara thereby providing for single stroke application.

It is a further object of the invention to provide a mascara brush which may be effectively utilized with high viscosity mascara formulations.

It is a still further object of the invention to provide a mascara brush capable of effectively reaching the corners and roots of eyelashes for optimal application of product.

The present invention contemplates an improved mascara brush having three sections or zones of bristle configuration along the length of the brush portion. The middle cylindrical section is comprised of a combination of stiff and supple bristles intermingled in random arrangement, and the end portions are comprised of a third type of bristle.

The diameter of the middle portion of the brush is preferably 0.325 inches or greater, larger than that of the standard mascara brush. The bristles of the middle section are preferably comprised of a combination of stiff, irregularly-shaped synthetic "goat" fibers of about 0.004 to 0.006 inches and soft ultrafine fibers of about 0.001 to 0.002 inches in diameter. These fibers are inserted between the legs of a wire axis which has been twisted in a helical formation and inserted into a rod which extends from the cap of the mascara container. By virtue of their irregular shape, the stiff bristles are held by the wire in random configuration and are distributed throughout the middle section of the brush in a non-spiral arrangement.

The bristles contained in the end portions of the brush are preferably comprised of hollow synthetic fibers of about 0.004 to 0.006 inches in diameter, most preferably of about 0.005 inches. These fibers are gripped between the wire core in the standard fashion, such that the bristles extend out from the wire in a spiral, or helical, configuration. Preferably, one or both of the end sections are tapered such that the bristle length progressively decreases nearer the tip and/or base of the brush. The bristle density of these end sections is significantly less than that of the middle section of the brush.

DETAILED DESCRIPTION OF THE INVENTION

Figure 1:
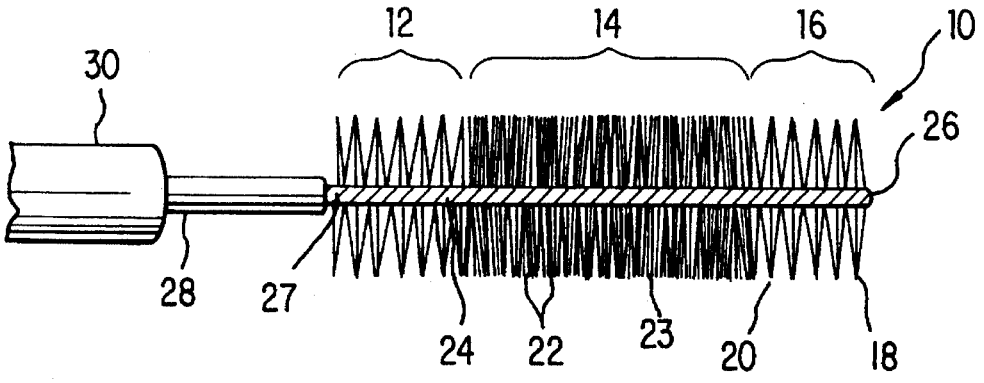
FIG. 1 is a longitudinal side view of a mascara brush according to the present invention.

A mascara brush according to the present invention is shown in FIG. 1. The brush portion 10 is comprised of a plurality of bristles arranged in three distinct sections or zones 12,14,16 throughout the length of the brush—a middle section 14 and two end sections 12,16. The sections are distinguished by the diameter and stiffness of the bristles found in each section.

The bristles of all three sections of the brush are mounted to a metal wire 24 which is bent at its midpoint, forming the brush tip 26, and twisted about itself in a helical configuration as is known in the art. The pitch of the metal helix is preferably about 15.0 to 19.0 turns per inch. The wire 24 of the core has a diameter of about 0.0270 to 0.0290 inches. The bristles are gripped at their midpoints between the twisted wire and extend outwardly from the helical axis 24. Opposite the brush tip 26, the wire axis extends longitudinally beyond the last bristle at the base 27 of the brush portion 10 and is fixedly housed in a hollow rod 28 projecting from a cylinder 30, which may function as the cap of the mascara container.

The middle section 14 of the brush 10 is generally cylindrical in shape due to the fact that the bristles 22 of this section are of relatively uniform length. The diameter of the middle section 14 of the brush portion is preferably about 0.325 inches or greater, most preferably about 0.350 inches. This diameter is significantly greater than that of the standard mascara brush, so as to facilitate use with high viscosity mascara formulations and provide maximum exposure of the brush to the lashes. Longer bristles, such as the ones used in the present invention, were formerly believed to be too flexible to provide the stiffness and control required for mascara application. However, as is further shown below, the tri-sectional configuration and combination of bristle types utilized by the present invention allows for the use of such longer bristles while maintaining the stiffness required for optimal mascara application.

The bristles 22,23 utilized in the middle cylindrical section 14 of the brush are of two types: preferably, a soft bristle 23 for applying the mascara and a stiff bristle 22 for combing the mascara through the lashes. For purposes of this application, "soft" bristles are defined as those bristles which have relatively low flexural strength, i.e., resistance to bending, whereas "stiff" bristles have substantially greater flexural strength. Bristle stiffness varies depending on the bristle material, the diameter of the bristle and the bristle length. Thus, all other things being equal, a shorter bristle is more stiff than a longer bristle and a thicker bristle is stiffer than a thin bristle. Additionally, hollow bristles are generally more flexible than solid bristles of the same material and dimensions. As used herein, solid synthetic bristles having a diameter less than 0.004 inches are considered "soft" whereas solid synthetic bristles of 0.004 inches or greater diameter are considered "stiff."

Figure 2:
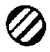
FIG. 2 is an enlarged cross-sectional view of a non-circular bristle as utilized in the middle section of a mascara brush according to the present invention.
Figure 3:
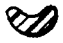
FIG. 3 is an enlarged cross-sectional view of a circular ultrafine bristle as utilized in the middle section of a mascara brush according to the present invention.

As shown in FIG. 2, the soft bristles are preferably of generally circular cross-section and may be formed of various synthetic fibers, such as polyamide, polyesters, polyolefin and the like. The diameter of the soft bristle fiber is preferably about 0.001 to 0.002 inches to provide the requisite suppleness for applying the mascara. As shown in FIG. 3, the stiff bristles are preferably of irregular or non-circular cross section, similar to that of natural goat hairs. These fibers may be formed synthetically from any of the known materials listed above. The preferred bristle has a diameter of about 0.004 to 0.006 inches, most preferably about 0.005 inches.

The combination of stiff bristles 22 and soft bristles 23 comprising the middle section 14 of the brush are fed together in random arrangement through the legs of the twisted wire axis 24 and gripped at their midpoints therein. The bristles 22,23 of the middle section 14 are more densely packed than the bristles 18,20 of the end sections 12,16. Preferably, the density of the stiff bristles 22 is about thirteen to twenty-four bristles per turn, and the bristle density of the soft bristles 23 is about ten to eighteen per turn. In the preferred embodiment, the non-circular stiff bristles 22 are held in random engagement with the wire axis 24 by virtue of their irregular shape. This irregular engagement causes the bristle fibers 22 to project outwardly in random formation, thereby producing a fuller, more uniform bristle distribution throughout the middle section 14 of the brush.

Figure 4:
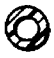
FIG. 4 is an enlarged cross-sectional view of a hollow bristle as utilized in the tapered end section of a mascara brush according to the present invention.

The end sections 12,16 of the brush 10 are comprised of a plurality of stiff bristles 18,20 preferably of a different bristle type than the stiff bristles 22 used in the middle cylindrical section 14 of the brush. For example, as shown in FIG. 4, the bristles 18,20 utilized in the preferred embodiment are tubular fibers of hollow circular cross-section. These bristles 18,20 are known to be manufactured of various synthetic materials, such as polyamide, polyesters, and polyolefins, and are available in varying diameters. The preferred embodiment utilizes a hollow nylon fiber of about 0.004 to 0.006 inches in outer diameter, most preferably about 0.005 inches.

The fibers 18,20 utilized in the end sections 12,16 of the brush are gripped between the legs of the wire axis 24 at their midpoints. It is known that hollow fibers have a tendency to flare outwardly in a substantially V-shaped arrangement, thereby producing a random distribution of bristles at the face of the brush. However, it is preferred in the present invention that the end sections 12,16 of the brush maintain a spiral arrangement. Therefore, when using hollow bristles in the end sections 12,16 of the brush, the bristle density must be adjusted to assure a substantially spiral arrangement in these end sections, while remaining less densely packed than the middle section 14 of bristles. For example, the preferred embodiment incorporates a bristle density of about twenty-seven bristles per turn in the end sections 12,16 of the brush.

Figure 5:
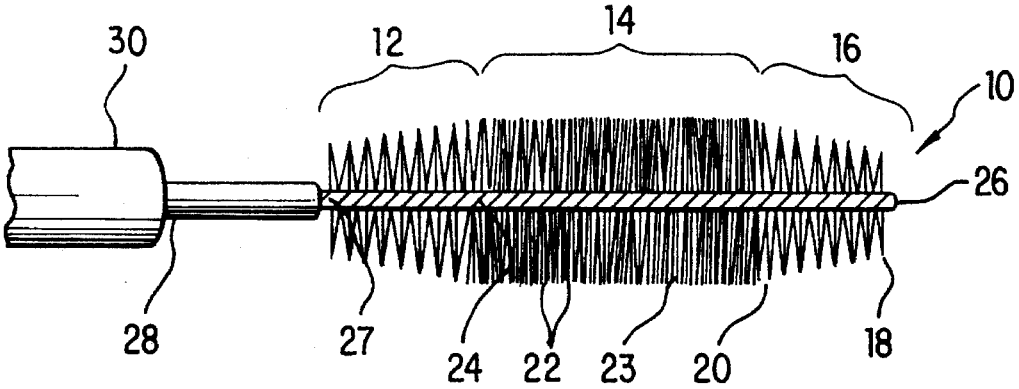
FIG. 5 is a longitudinal side view of a second embodiment of a mascara brush according to the present invention.

As shown in FIG. 5, one or both of the end sections 12,16 of the brush are preferably designed to have a sharp taper such that the bristles 18 at either end of the brush are progressively shorter than those bristles 20 immediately adjacent to the middle section 14 of the brush portion 10. Unlike brushes which utilize an elliptical or football shape, the sharp taper of this preferred embodiment clearly distinguishes the end sections 12,16 of the brush from the middle section 14 of the brush. This sharp taper has several advantages. For example, the tip end section 16 is useful as a styling tool for reaching into corners and combing through the delicate lashes of the lower eyelid. On the other hand, the short, stiff bristles of the base end section 12 serve to keep the middle section 14 of the brush cleaner upon removal from a mascara container by dispensing of any excess mascara accumulated at the opening of the container before it reaches the longer, more flexible bristles 22,23 of the middle section 14.

Therefore, while there have been described what are at present considered to be the preferred embodiments of this invention, it will be obvious to those skilled in the art that various changes and modifications may be made without departing from the invention, and it is, therefore, aimed to cover all such changes and modifications that fall within the true spirit and scope of the invention.

What is claimed is:

1. A mascara brush, comprising:

a twisted wire core extending longitudinally; and a plurality of bristles mounted to said twisted wire core, said plurality of bristles comprising a middle cylindrical section containing a plurality of at least first and second different bristle types of relatively uniform length randomly intermingled throughout the length of said middle section and two end sections containing a third type of bristles.

2. A mascara brush according to claim 1 wherein said plurality of bristle types comprises at least one relatively soft bristle type and one relatively stiff bristle type.

3. A mascara brush according to claim 2 wherein the diameter of said middle cylindrical section is at least about 0.325 inches.

4. A mascara brush according to claim 2 wherein at least one of said end sections is tapered, said third type of bristles progressively decreasing in length toward the end of said at least one tapered section.

5. A mascara brush according to claim 4 wherein said middle cylindrical section has greater bristle density than said end sections.

6. A mascara brush according to claim 5, wherein said bristle density in each said section is uniform throughout each section.

7. A mascara brush according to claim 5 wherein said soft bristles are comprised of fibers having a diameter of about 0.001 to 0.002 inches.

8. A mascara brush according to claim 5 wherein said stiff bristles are comprised of fibers of non-circular cross-section having a diameter of from about 0.004 to 0.006 inches.

9. A mascara brush according to claim 5 wherein said end section bristles are formed of hollow filaments of generally circular cross-section.

10. A mascara brush according to claim 9 wherein said end section bristles are comprised of filaments having an outer diameter of about 0.004 to 0.006 inches.

11. A mascara brush, comprising:

a tip section terminating at a tip, including first bristles having a first diameter and stiffness;

a middle section adjacent said tip section, said middle section including second bristles having a second diameter and stiffness and third bristles having a third diameter and stiffness, wherein said second and third bristles are blended together in the middle section; and a base section adjacent said middle section and opposite said tip section, said base section including said first bristles.

12. A mascara brush according to claim 11 wherein said tip section is tapered, with said first bristles of said tip section progressively decreasing in length toward said tip.

13. A mascara brush according to claim 12 wherein said base section is tapered, with said first bristles of said base section progressively decreasing in length toward a base opposite the middle section.

14. A mascara brush according to claim 13 wherein said second and third bristles have a length greater than a majority of said first bristles.

15. A mascara brush according to claim 14 wherein the diameter of said middle section is at least about 0.325 inches.

16. A mascara brush according to claim 15 wherein said middle section has greater bristle density than said tip and base sections.

17. A mascara brush according to claim 16 wherein said second bristles are comprised of synthetic fibers having a diameter of about 0.001 to 0.002 inches.

18. A mascara brush according to claim 17 wherein said third bristles are comprised of synthetic fibers of non-circular cross-section.

19. A mascara brush according to claim 18 wherein said third bristles are comprised of synthetic fibers having a diameter of from about 0.004 to 0.006 inches.

20. A mascara brush according to claim 16 wherein said first bristles are formed of hollow filaments of generally circular cross section.

21. A mascara brush according to claim 20 wherein said first bristles are comprised of synthetic filaments having an outer diameter of about 0.004 to 0.006 inches.

* * * * *